US010068555B2

(12) United States Patent
Kim et al.

(10) Patent No.: US 10,068,555 B2
(45) Date of Patent: Sep. 4, 2018

(54) DISPLAY DRIVING CIRCUIT AND DISPLAY DEVICE INCLUDING THE SAME

(71) Applicant: Samsung Electronics Co., Ltd., Suwon-si, Gyeonggi-do (KR)

(72) Inventors: Yang-Hyo Kim, Suwon-si (KR); Chul-Ho Kim, Yongin-si (KR); Sun-Young Kim, Hwaseong-si (KR); Hak-Song Kim, Yongin-si (KR); Sang-Hoon Lim, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 9 days.

(21) Appl. No.: 15/158,804

(22) Filed: May 19, 2016

(65) Prior Publication Data

US 2016/0343355 A1 Nov. 24, 2016

(30) Foreign Application Priority Data

May 19, 2015 (KR) ..... 10-2015-0069586

(51) Int. Cl.

| | |
|---|---|
| ***G09G 5/36*** | (2006.01) |
| ***G09G 5/399*** | (2006.01) |
| ***G09G 5/00*** | (2006.01) |
| *G09G 5/12* | (2006.01) |

(52) U.S. Cl.

CPC ..... *G09G 5/399* (2013.01); *G09G 5/003* (2013.01); *G09G 5/006* (2013.01); *G09G 5/001* (2013.01); *G09G 5/12* (2013.01); *G09G 2310/04* (2013.01); *G09G 2330/021* (2013.01); *G09G 2350/00* (2013.01); *G09G 2360/18* (2013.01)

(58) Field of Classification Search

CPC ..... G09G 2360/18; G09G 2310/04; G09G 5/399; G09G 5/18; G09G 5/393

See application file for complete search history.

(56) References Cited

U.S. PATENT DOCUMENTS

| | | | |
|---|---|---|---|
| 7,289,045 | B1 | 10/2007 | Walls et al. |
| 7,889,191 | B2 | 2/2011 | Simpson |
| 8,004,535 | B2 | 8/2011 | Blaukopf et al. |

(Continued)

FOREIGN PATENT DOCUMENTS

| | | | |
|---|---|---|---|
| JP | 2003/204458 | A | 7/2003 |
| JP | 2010/026394 | A | 2/2010 |

(Continued)

*Primary Examiner* — Hua H Nguyen

(74) *Attorney, Agent, or Firm* — Harness, Dickey & Pierce, P.L.C.

(57) ABSTRACT

An display driving circuit including a buffer write controller transmitting a different image frame to a first buffer or a second buffer, a buffer scan controller scanning an image frame stored in the first buffer or the second buffer on the basis of a predetermined cycle, a write signal detector controlling the buffer write controller such that a second image frame is transmitted to the second buffer after a first image frame is transmitted to the first buffer, and a scan buffer switching controller receiving an EOF (End of Frame) command indicating the completion of transmission of the first image frame to the first buffer and controlling the buffer scan controller such that the first image frame stored in the first buffer is scanned after the image frame previously stored in the second buffer is scanned.

7 Claims, 13 Drawing Sheets

(56) References Cited

U.S. PATENT DOCUMENTS

| | | | | |
|---|---|---|---|---|
| 8,581,919 | B2 * | 11/2013 | Park | G09G 3/3611 345/531 |
| 8,723,878 | B2 | 5/2014 | Bae et al. | |
| 2006/0227104 | A1 | 10/2006 | Kim | |
| 2009/0015591 | A1 * | 1/2009 | Tanaka | G09G 5/399 345/547 |

FOREIGN PATENT DOCUMENTS

| | | | |
|---|---|---|---|
| JP | 2011/039302 | A | 2/2011 |
| JP | 2011/066498 | A | 3/2011 |
| JP | 2011/102874 | A | 5/2011 |
| KR | 10-0843615 | | 7/2008 |

* cited by examiner

Vsync
TE
CMD:SLEEPOUT
1st EOF & Display on
2nd EOF
3rd EOF
4th EOF
DDI input
1st image
2nd image
3rd image
4rd image
5rd image
Write Controller
Buffer 1
Buffer 2
Buffer 1
Buffer 2
Scan Controller
Buffer 2
Buffer 1
Buffer 2
Buffer 1
Buffer 1
Buffer 2
Buffer 1
Buffer 2
Buffer 1
Buffer 2

DISPLAY DRIVING CIRCUIT AND DISPLAY DEVICE INCLUDING THE SAME

CROSS-REFERENCE TO RELATED APPLICATION

This application claims priority from Korean Patent Application No. 10-2015-0069586 filed on May 19, 2015 in the Korean Intellectual Property Office, and all the benefits accruing therefrom under 35 U.S.C. 119, the contents of which in its entirety are herein incorporated by reference.

BACKGROUND

Example embodiments of the inventive concepts relate to a display driving circuit and/or a display device including the same.

A display device includes a display driving circuit (display driving integrated circuit: DDI). With the advancement of technology, the portability of various electronic products may increase, the miniaturization thereof may proceed, and the need for outputting a high-resolution image may increase. Therefore, the display driving circuits that drive display panels may need changes.

Specifically, the display driving circuit may receive successive image frames from a host, and may control the display panel such that these image frames are displayed on a screen.

Generally, the display panel may display image frames at a speed of 60 Hz or more. However, when the image frame transmission speed of the host is irregular, the writing speed of a buffer included in the display panel may be slower than the speed for displaying an image on the display panel, and, in this case, an image tearing phenomenon may occur in the display panel.

SUMMARY

Aspects of the example embodiments of the inventive concepts provide a display driving circuit which is configured to enable a reliable display on a display panel even when the image frame transmission speed of a host is irregular.

However, aspects of the example embodiments of the inventive concepts are not restricted to the one set forth herein. The above and other aspects of the example embodiments of the inventive concepts will become more apparent to one of ordinary skill in the art to which the example embodiments of the inventive concepts pertains by referencing the detailed description of the example embodiments of the inventive concepts given below.

According to example embodiments of the inventive concepts, there is provided a display driving circuit including a buffer write controller transmitting a different image frame to a first buffer or a second buffer, a buffer scan controller scanning an image frame stored in the first buffer or the second buffer on the basis of a desired (or, alternatively, a predetermined) cycle, a write signal detector controlling the buffer write controller such that a second image frame is transmitted to the second buffer after a first image frame is transmitted to the first buffer, and a scan buffer switching controller receiving an EOF (End of Frame) command indicating the completion of transmission of the first image frame to the first buffer and controlling the buffer scan controller such that the first image frame stored in the first buffer is scanned after the image frame previously stored in the second buffer is scanned.

In some example embodiments of the inventive concepts, wherein the write signal detector externally receives the EOF command each time the transmission of each of the image frames is completed, and changes a target buffer, to which an image frame is transmitted by the buffer write controller, on the basis of the EOF command.

In some example embodiments of the inventive concepts, wherein the write signal detector creates the EOF command each time the transmission of each image frame is completed, and transmits the EOF command to the scan buffer switching controller.

In some example embodiments of the inventive concepts, wherein the scan buffer switching controller receives an EOS (End Of Scan) command indicating the completion of scanning of the first image frame, and changes a target buffer to be scanned by the buffer scan controller when both the EOF command for the first image frame and the EOS command are received.

In some example embodiments of the inventive concepts, further including a timing controller creating the EOS command indicating the completion of scanning of the image frame, a first periodic signal or a second periodic signal, wherein the timing controller activates the first periodic signal only when an EOF command indicating the completion of transmission of a specific image frame is received and an EOS command for the specific image frame is created.

According to example embodiments of the inventive concepts, there is provided a display device including a host transmitting successive image frames and transmitting an EOF command each time the transmission of each of the image frames is completed, and a display driving circuit receiving the successive image frames and transmitting the received image frames to a display panel, wherein the display driving circuit including a first buffer and a second buffer storing image frames different from each other, a buffer write controller transmitting the image frame to any one of the first buffer and the second buffer, a buffer scan controller scanning the image frame stored in any one of the first buffer and the second buffer, a write signal detector switching a target buffer, to which the image frame is transmitted by the buffer write controller, on the basis of the EOF command, and a scan buffer switching controller switching a target buffer, which is scanned by the buffer scan controller, on the basis of the EOF command and the EOS command created each time the transmission of each of the image frames to the display panel is completed.

In some example embodiments of the inventive concepts, wherein the EOF command is added and transmitted to the end of each image frame, and the write signal detector changes the address value of a target buffer assigned to the buffer write controller when the EOF command is detected from the data received from the host.

In some example embodiments of the inventive concepts, wherein the scan buffer switching controller changes the address value of a target buffer assigned to the buffer scan controller when the EOF command for a specific image frame and the EOS command for the specific image frame are received.

In some example embodiments of the inventive concepts, further comprising: a bridge which is disposed between the host and the display driving circuit, and the bridge receives an image frame from the host through a first protocol, converts the received image frame in accordance with a second protocol used in the display driving circuit, and transmits the converted image frame to the display driving circuit.

In some example embodiments of the inventive concepts, further including a timing controller creating the EOS command and a desired (or, alternatively, a predetermined) first periodic signal, wherein the timing controller activates the first periodic signal only when an EOF command indicating the completion of transmission of a specific image frame is received and an EOS command for the specific image frame is created.

In some example embodiments of the inventive concepts, wherein the host transmits an image frame to the display driving circuit each time the periodic signal is activated.

In some example embodiments of the inventive concepts, wherein the periodic signal is transmitted to the host, the host transmits the image frame on the basis of the periodic signal, and the EOS command or the periodic signal is transmitted to the scan buffer switching controller.

According to other the example embodiments of the inventive concepts, there is provided a display driving circuit including a first buffer and a second buffer, each storing an image frame, a buffer write controller receiving successive image frames and alternately transmitting the received image frames to the first buffer or the second buffer, and a buffer scan controller alternately scanning the image frames stored in the first buffer or the second buffer, wherein, when the second image frame subsequent to the first image frame includes only the updated information about a partial area of the first image frame, the buffer write controller transmits the first image frame to the first buffer, transmits the first image frame to the second buffer again, and then transmits only the updated partial area of the first image frame to the first buffer.

In some example embodiments of the inventive concepts, wherein the first buffer and the second buffer store image frames different from each other in the first cycle in which the first image frame is transmitted to the first buffer, and the first buffer and the second buffer store image frames identical to each other in the second cycle subsequent to the first cycle.

In some example embodiments of the inventive concepts, wherein the entire first image frame is transmitted in the first cycle and the second cycle, and only the updated partial area of the first image frame is transmitted in the third cycle subsequent to the second cycle.

Other example embodiments relate to a display driving circuit configured to process image frames.

In some example embodiments, the display driving circuit may include a driving controller configured to, alternately transmit a first one of the image frame received from a host to a first buffer and a second image frame received from the host to a second buffer based on an End Of Frame (EOF) command, the first image frame being a different image from the second image frame and the EOF command indicating that the host has completed transmission of a respective one of the image frames; and alternately scan the first buffer and the second buffer based on at least the EOF command such that the second buffer is scanned after the first buffer is scanned.

In some example embodiments, the display driving circuit may be configured to generate an End of Scan (EOS) command, if the driving controller completes scanning one of the first buffer and the second buffer, the EOS command indicating that the driving controller has completed scanning the one of the first buffer and the second buffer and transmitted a respective one of the first image frame and the second image frame to a display panel.

In some example embodiments, the driving controller may be configured to generate one or more of a first periodic signal and a second periodic signal, and the first periodic signal instructing the host to transmit a next one of the image frames.

In some example embodiments, the driving controller is configured to alternately scan the first buffer and the second buffer based on the EOF command and the EOS command.

In some example embodiments, the driving controller is configured to re-scan a first one of the first buffer and the second buffer until confirmation that a second one of the first buffer and the second buffer has been updated.

BRIEF DESCRIPTION OF THE DRAWINGS

The above and other objects, features and advantages of the example embodiments of the inventive concepts will be more clearly understood from the following detailed description taken in conjunction with the accompanying drawings, in which.

DETAILED DESCRIPTION

Figure 1:
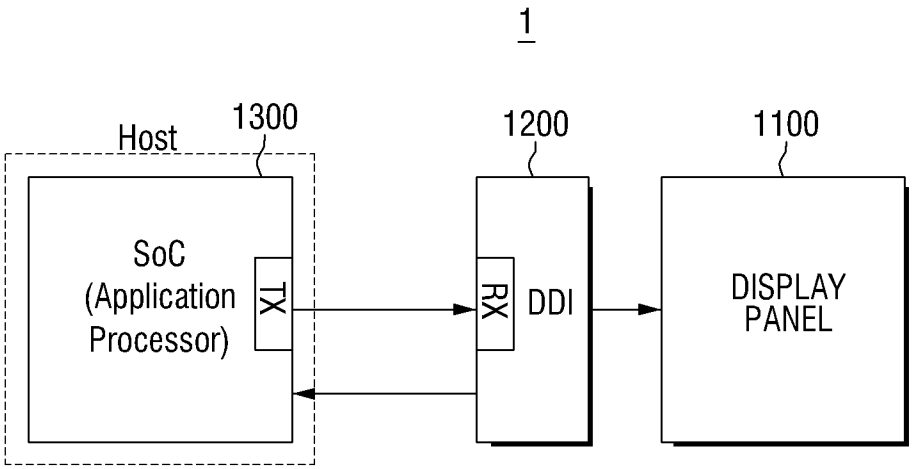
FIG. 1 is a block diagram illustrating a display device according to an example embodiments of the inventive concepts.

Advantages and features of the example embodiments of the inventive concepts and methods of accomplishing the same may be understood more readily by reference to the following detailed description of preferred embodiments and the accompanying drawings. The example embodiments of the inventive concepts may, however, be embodied in many different forms and should not be construed as being limited to the embodiments set forth herein. Rather, these example embodiments are provided so that this disclosure will be thorough and complete and will fully convey the inventive concepts to those skilled in the art, and the example embodiments of the inventive concepts will only be defined by the appended claims. Like reference numerals refer to like elements throughout the specification.

The terminology used herein is for the purpose of describing particular example embodiments only and is not intended to be limiting of the example embodiments of the inventive concepts. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the example embodiments of the inventive concepts.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein but are to include deviations in shapes that result, for example, from manufacturing. As an example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the example embodiment of the inventive concepts.

Unless otherwise defined, all terms (including technical and scientific terms) used herein have the same meaning as commonly understood by one of ordinary skill in the art to which the example embodiments of the inventive concepts belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, display driving circuits and display devices including the same according to some example embodiments of the inventive concepts will be described with reference to FIGS. 1 to 10.

FIG. 1 is a block diagram illustrating a display device according to example embodiments of the inventive concepts.

Referring to FIG. 1, the display device 1 according to example embodiments of the inventive concepts may be any one of various display devices. Examples thereof may include organic light-emitting diode displays (OLEDs), liquid crystal display (LCDs), electrochromic displays (ECDs), digital mirror devices (ECDs), actuated mirror devices (AMDs), grating light values (GLVs), plasma display panels (PDPs), and electroluminescent displays (ELDs).

The display device 1 according to example embodiments of the inventive concepts may include a display panel 1100, a display driving circuit 1200, and a host 1300.

The display panel 1100 is configured such that an image is displayed according to image data. The display panel 1100 may include pixels arranged and supplied in a matrix form.

In some example embodiments, the host 1300 may include an application processor or a System On Chip (SOC) and a transmitting unit (TX).

In some example embodiments, the transmitting unit TX may include transmitters and/or receivers. The transmitters may include hardware and any necessary software for transmitting signals including, for example, data signals and/or control signals. The receivers may include hardware and any necessary software for receiving signals including, for example, data signals and/or control signals.

The host 1300 provides image data (DATA) and control commands (CMDs) to the display driving circuit 1200. The host 1300 can transmit image data (DATA) and control commands (CMDs) through the transmitting unit (TX). The transmitting unit (TX) may use a first protocol.

The display driving circuit 1200 may include a display driving integrated circuit (DDI) and an interfacing unit (RX).

In some example embodiments, the interfacing unit (RX) may include transmitters and/or receivers. The transmitters may include hardware and any necessary software for transmitting signals including, for example, data signals and/or control signals. The receivers may include hardware and any necessary software for receiving signals including, for example, data signals and/or control signals.

The display driving circuit 1200 controls the display panel 1100 based on image data (DATA) and control commands (CMDs). The display driving circuit 1200 can receive the image data (DATA) and the control commands (CMDs) from the host 1300 through the interface unit (RX). The interface unit (RX) can use the first protocol. That is, the transmitting unit (TX) of the host 1300 and the interface unit (RX) of the display driving circuit 1200 may use the same protocol (for example, first protocol).

The display driving circuit 1200 may transmit a first periodic signal (TE) to the host 1300 to synchronize the display driving circuit 1200 with the host 1300. As will be described in more detail later, the host 1300 can transmit one image frame to the display driving circuit 1200 for each period of the first periodic signal (TE). However, the example embodiments of the inventive concepts are not limited thereto.

The display device 1 may include a plurality of display driving circuits (not shown). The plurality of display driving circuits (not shown) may be designed to control only a part of the display panel 1100.

When one display panel 1100 is driven by the plurality of display driving circuits (not shown), the size of the display device 1 can be reduced. For example, when one display panel 1100 is controlled by one display driving circuit 1200, the distance between the display driving circuit 1200 and the display panel 1100 is increased. In contrast, for example, when the plurality of display driving circuits (not shown) are used, the distance between each of the plurality of display driving circuits and the display panel 1100 can be remarkably decreased. However, the example embodiments of the inventive concepts are not limited thereto.

Figure 2:
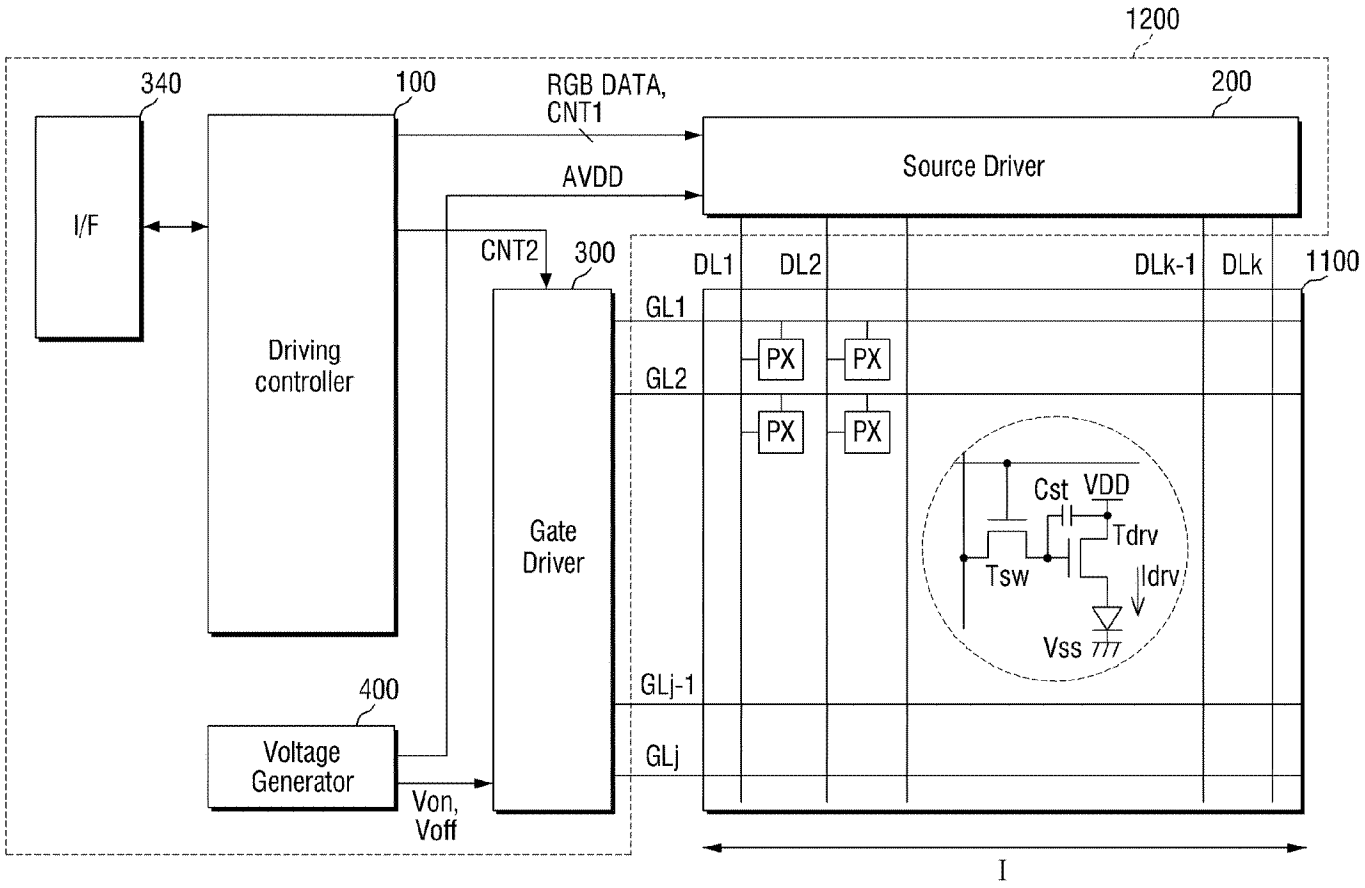
FIG. 2 is a block diagram illustrating the display driving circuit and the display panel included in the display device of FIG. 1.

FIG. 2 is a block diagram illustrating the display driving circuit and the display panel of display device of FIG. 1.

Referring to FIG. 2, the display panel 1100 may be an organic light-emitting panel. However, the example embodiments of the inventive concepts are not limited thereto.

The display panel 1100 may include a plurality of gate lines (GL1~GLj) transmitting scan signals in a row direction; a plurality of data lines (DL1~DLk) disposed in a direction crossing the gate lines and transmitting data signals in a column direction; and a plurality of pixels (PX) arranged in the intersections of the gate lines (GL1~GLj) and the data lines (DL1~DLk).

When the plurality of gate lines (GL1~GLj) are sequentially selected, the display driving circuit 1200 may apply a grayscale voltage to the pixel (PX) connected to the selected gate line through the plurality of data lines (DL1~DLk).

Each of the pixels (PX) may include a switching transistor (Tsw), a driving transistor (Tdrv), a storage capacitor (Cst), and an organic light-emitting diode (D). The gate line (GL) and the data (DL) are respectively connected to the gate electrode and source electrode of the switching transistor (Tsw), the drain electrode and power supply voltage (VDD) of the switching transistor (Tsw) are respectively connected to the gate terminal and source terminal of the driving transistor (Tdrv), and the drain terminal of the driving transistor (Tdrv) is connected to the anode of the organic light-emitting diode (D) and the cathode of the diode connects to the ground. In this pixel structure, when the gate line (GL) is selected, the switching transistor (Tsw) turns on to allow the grayscale voltage provided through the data line (DL) to be applied to the gate terminal of the driving transistor (Tdrv), and driving current (Idrv) due to the difference in voltage between the power supply voltage (VDD) and the grayscale voltage flows through the organic light-emitting diode (D) to emit light, thereby conducting a display operation.

The display driving circuit 1200 may include a driving controller 100, a source driver 200, a gate driver 300, a voltage generator 400, and an interface unit 340.

The driving controller 100 may include a memory and a processor (not shown).

The memory may be a non-volatile memory, a volatile memory, a hard disk, an optical disk, and a combination of two or more of the above-mentioned devices. The memory may be a non-transitory computer readable medium. The non-transitory computer-readable media may also be a distributed network, so that the program instructions are stored and executed in a distributed fashion. The non-volatile memory may be a Read Only Memory (ROM), a Programmable Read Only Memory (PROM), an Erasable Programmable Read Only Memory (EPROM), or a flash memory. The volatile memory may be a Random Access Memory (RAM).

The processor may be implemented by at least one semiconductor chip disposed on a printed circuit board. The processor may be an arithmetic logic unit, a digital signal processor, a microcomputer, a field programmable array, a programmable logic unit, a microprocessor or any other device capable of responding to and executing instructions in a defined manner such that the processor is programmed with instructions that configure the processor into a special purpose computer to alternately transmit a first one of image frame received from the host 1300 to a first buffer (e.g., buffer 122 of FIG. 3) and a second image frame received from the host 1300 to a second buffer (e.g., buffer 124 of FIG. 3) based on an End Of Frame (EOF) command, and the EOF command indicating that the host 1300 has completed transmission of a respective one of the image frames, and alternately scan the first buffer and the second buffer based on at least the EOF command such that the second buffer is scanned after the first buffer is scanned. Therefore, the processor may improve the functioning of the driving controller 100 itself by reducing (or, alternatively eliminating) an image distortion phenomenon occurring due to a next one of the first buffer and the second buffer not being updated at a scanning time when the transmission speed from the host 1300 to the display driving circuit 1200 is irregular.

The driving controller 100 receives the image data (DATA) and the control commands (CMD) from the host (1300 of FIG. 1) of an external system, for example, a system mounted with the display device 1, and transmits control signals (CNT1, CNT2) and pixel data (RGB DATA) necessary for operation to the source driver 200 and the gate driver 300.

The source driver 200 converts the pixel data (RGB DATA), which is digital data received from the driving controller 100, into grayscale voltage, and output this grayscale voltage to the data lines (DL1~DLk) of the display panel 1100. The gate driver 300 sequentially scans the gate lines (GL1~GLj) of the display panel 1100. The gate driver 300 applies a gate on voltage (Von) to the selected gate line to activate this gate line, and the source driver 200 outputs grayscale voltages corresponding to the pixels connected to the activated gate line. Accordingly, the display panel 1100 is configured such that an image can be displayed for each horizontal line, located in a row.

The voltage generator 400 externally receives a power supply voltage (VCI), and generates voltages (AVDD, Von, Voff) for the source driver 200 and the gate driver 300.

The interface (I/F) 340 serves to communicate with the host 1300 (for example, the application processor of the host 1300). The interface 340 receives image data (DATA) and control commands (CMD) transmitted in parallel or in series from the host 1300, and transmits these image data (DATA) and control commands (CMD) to the driving controller 100. The interface 340 may be disposed outside or inside of the driving controller 100.

The interface unit 340 can receive image data (DATA) and control commands (CMD) according to the first protocol corresponding to the transmission system of the host 1300. The interface unit 340 includes protocols for performing data exchange between the host 1300 and the driving controller 100. For example, the first protocol used in the interface 340 is configured to communicate with the outside (for example, host 1300) through at least one of various interface protocols such as USB (Universal Serial Bus) protocol, MMC (multimedia card) protocol, PCI (peripheral component interconnection) protocol, PCI-E (PCI-express) protocol, ATA (Advanced Technology Attachment) protocol, Serial-ATA protocol, Parallel-ATA protocol, SCSI (small computer small interface) protocol, ESDI (enhanced small disk interface) protocol, and IDE (Integrated Drive Electronics) protocol; and PSI (Service provider interface), MDDI (Mobile display digital interface), and MIPI (Mobile industry processor interface). However, example embodiments of the inventive concepts are not limited thereto.

Figure 3:
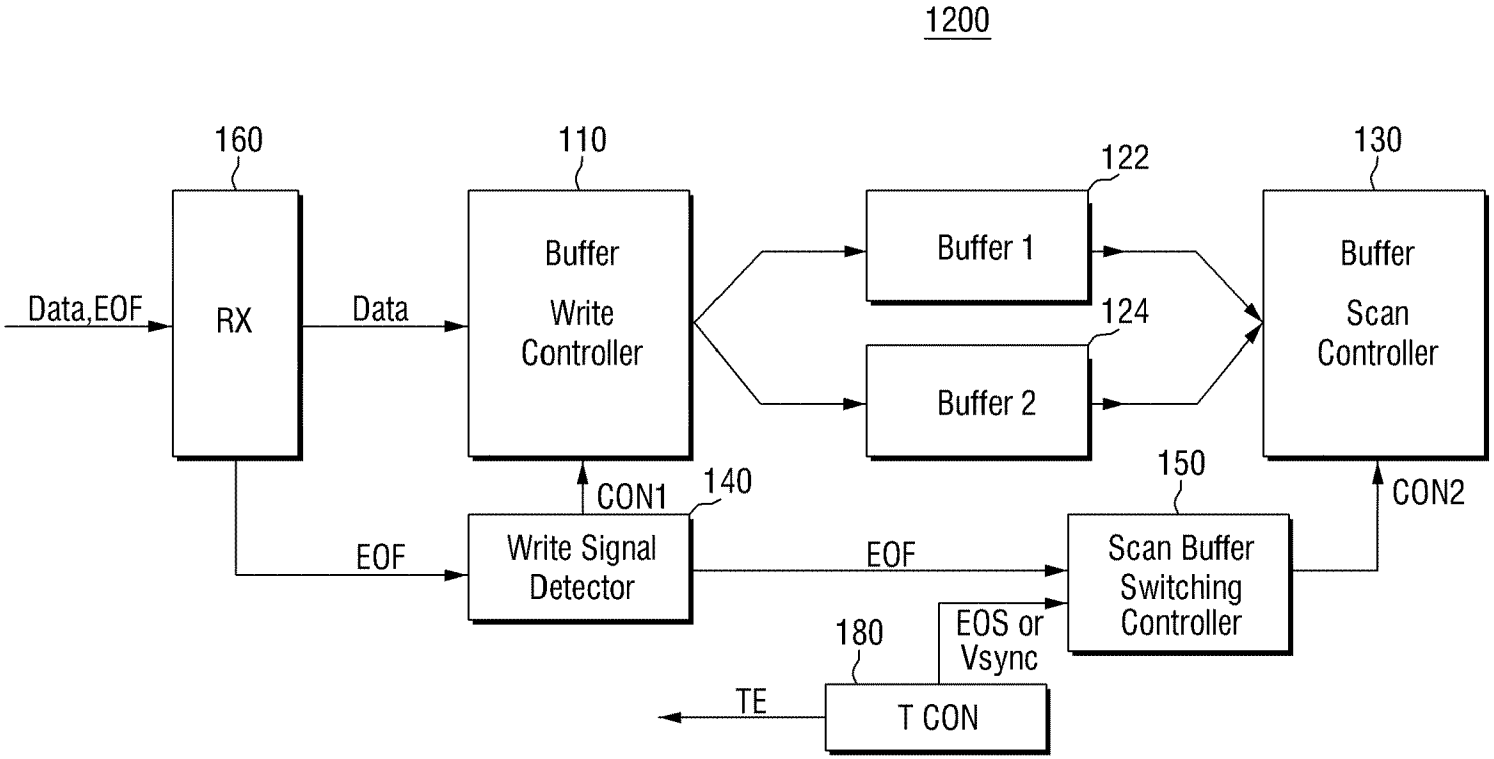
FIG. 3 is a block diagram illustrating a display driving circuit according to an example embodiments of the inventive concepts.

FIG. 3 is a block diagram illustrating a display driving circuit according to example embodiments of the inventive concepts.

Referring to FIG. 3, the display driving circuit 1200 according to an example embodiments of the inventive concepts may include a buffer write controller 110, a buffer scan controller 130, a write signal detector 140, a scan buffer switching controller 150, a first buffer (buffer 1) 122, a second buffer (buffer 2) 124, a timing controller (TCON) 180, and an interface unit (RX) 160.

In some example embodiments, the driving controller 100 included the display driving circuit 1200 may be configured to function as the buffer write controller 110, the buffer scan controller 130, the write signal detector 140, the scan buffer switching controller 150, the first buffer 122, the second buffer 124, the timing controller (TCON) 180, and the interface unit (RX) 160.

The first buffer 122 can store data. For example, the first buffer 122 can store one image frame. The first buffer 122 may include at least one volatile memory device such as double data rate static DRAM (DDR SDRAM) or single data rate static DRAM (SDR SDRAM) and/or a non-volatile memory device such as electrical erasable programmable ROM (EEPROM) or flash memory. The second buffer 124 substantially has the same configuration and function as the first buffer 122. The buffer write controller 110 can transmit the above image frame to any one of the first buffer 122 and the second buffer 124.

The buffer write controller 110 can alternately transmit different image frames to the first buffer 122 or the second buffer 124. For example, the buffer write controller 110 can transmit a first image frame to the first buffer 122, and then transmit a second image frame immediately subsequent to the first image frame to the second buffer 124. Then, the buffer write controller 110 can transmit a third image frame immediately subsequent to the second image frame to the first buffer 122. In this way, different image frames can be alternately transmitted to the first buffer 122 and the second buffer 124.

The buffer write controller 110 can be controlled by the write signal detector 140. The buffer write controller 110 can switch the target buffer accessed by the first command (CON1) of the write signal detector 140. The first command (CON1) may include the address value (for example, first buffer 122 or second buffer 124) of the target buffer, this address value being able to be accessed by the buffer write controller 110.

The buffer scan controller 130 can scan the image frame stored in any one of the first buffer 122 and the second buffer 124. Specifically, the buffer scan controller 130 can alternately scan the image frames stored in the first buffer 122 or the second buffer 124. For example, the buffer scan controller 130 can scan the first image frame stored in the first buffer 122, and then scan the second image frame stored in the second buffer 124. Subsequently, the buffer scan controller 130 can scan the third image frame stored in the first buffer 122. In this way, different image frames stored in the first buffer 122 or the second buffer 124 can be alternately scanned.

Meanwhile, the buffer scan controller 130 and the buffer write controller 110 can be complementarily operated to each other. For example, while the buffer scan controller 130 scans a buffer, the buffer write controller 110 can be operated such that an image frame is not recorded in this buffer. That is, the buffer scan controller 130 and the buffer write controller 110 can be operated to access different buffers. However, the example embodiments of the inventive concepts are not limited thereto.

The buffer scan controller 130 can perform the scanning operation for each desired (or, alternatively, predetermined) period. The buffer scan controller 130 can be controlled by the scan buffer switching controller 150. The buffer scan controller 130 can switch the target buffer accessed by the second command (CON2) of the scan buffer switching controller 150. The second command (CON2) may include the address value (for example, first buffer 122 or second buffer 124) of the target buffer, this address value being able to be accessed by the buffer scan controller 130.

The write signal detector 140 can control the buffer write controller 110 to switch the target buffer accessed by the buffer write controller 110. Specifically, the write signal detector 140 can control the buffer write controller 110 such that the second image frame is transmitted to the second buffer 124 after the first image frame is transmitted to the first buffer 122.

The write signal detector 140 can receive an End of Frame (EOF) command. The EOF command is a command signal indicating that the transmission of one image frame is completed. The write signal detector 140 can switch the target buffer, to which an image frame is transmitted by the buffer write controller 110, on the basis of the EOF command. The EOF command can be received each time one image frame is transmitted from the host 1300 to the display driving circuit 1200. The EOF command can be received subsequently after the reception of a desired (or, alternatively, a predetermined) image frame is completed.

The host 1300 may generate the EOF command, and may transmit the EOF command to the display driving circuit 1200 each time the host 1300 completes the transmission of each image frame to the display driving circuit 1200. The write signal detector 140 can detect whether the EOF command is included in the data received from the host 1300. However, the example embodiments of the inventive concepts are not limited thereto. For example, in some example embodiments, the write signal detector 140 may detect completion of the transmission such that the write signal detector 140 directly creates the EOF command.

When the write signal detector 140 detects or creates the EOF command, the write signal detector 140 can output the first command (CON1) to switch the target buffer accessed by the buffer write controller 110. The write signal detector 140 can control the operation of the buffer write controller 110 through the first command (CON1). Therefore, the buffer write controller 110 switches the target buffer recording an image frame each time the host 1300 sends the EOF command or the write signal detector 140 creates the EOF command. For example, when the buffer write controller 110 records the first image frame in the first buffer and receives the first EOF command for the first image frame, the write signal detector 140 switches the target buffer accessed by the buffer write controller 110 to the second buffer 124. Subsequently, the buffer write controller 110 records the second image frame transmitted after the first image frame in the second buffer 124.

The scan buffer switching controller 150 can control the buffer scan controller 130 to switch the target buffer accessed by the buffer scan controller 130. Specifically, the scan buffer switching controller 150 can control the buffer scan controller 130 to scan the first image frame transmitted to the first buffer 122 when the scan buffer switching controller 150 receives the EOF command indicating the completion of the transmission of the first image frame from the write signal detector 140 to the first buffer 122 and the scanning of the image frame previously stored in the second buffer 124 is completed.

The image frame scanned by the scan buffer switching controller 150 can be immediately displayed on the display panel 1100. The operation of displaying the scanned image frame on the display panel 1100 can be controlled by the timing controller 180. The timing controller 180 can accurately determine the end point of the operation of displaying the scanned image frame on the display panel 1100, and can create an EOS (End Of Scan) command when the entire scanned image frame is displayed on the display panel 1100.

The scanning operation of the buffer scan controller 130 and the operation of displaying an image frame can be sequentially performed, and the scanned data can be immediately displayed on the display panel 1100. Therefore, the operation of displaying the image frame on the display panel can be completed simultaneously with the completion of scanning of the image frame. The EOS command can be created each time the scanning of the image frame is completed. That is, the EOS command indicates the completion of scanning of a specific image frame simultaneously with the completion of operation of displaying the specific image frame on the display panel 1100.

The scan buffer switching controller 150 can receive the EOF command for a specific image frame from the write signal detector 140, and can receive the EOS command for a specific image frame from the timing controller 180. The scan buffer switching controller 150 can switch the target buffer scanned by the buffer scan controller 130 on the basis of the received EOF command and EOS command. For example, the scan buffer switching controller 150 can receive the EOF command for the first image frame from the write signal detector 140, and can be receive the EOS command indicating the completion of scanning of the first image frame from the timing controller 180. Subsequently, the scan buffer switching controller 150 can transmit the second command (CON2) including the command switching the target buffer to be scanned.

In a conventional display device, a buffer scan controller may immediately scan a second image frame after scanning a first image frame, and, therefore the second image frame may be scanned prior to receipt thereof, and thus image tearing may occur.

In contrast, in one or more example embodiments, the scan buffer switching controller 150 may instruct the buffer scan controller 130 to rescan the first image frame again if the transmission of the second image frame is not completed after the buffer scan controller 130 scans the first image frame. Therefore, the display driving circuit 1200 may reduce (or, alternatively, prevent) the image tearing. Subsequently, the scan buffer switching controller 150 can allow the buffer scan controller 130 to scan the second image frame after the EOF command indicating the completion of transmission of the second image frame is received and the EOS command indicating the scanning of the first image frame is received.

In this way, in the case where the buffer switching is performed according to a desired (or, alternatively, a predetermined) periodic signal, the display driving circuit 1200 of the example embodiments of the inventive concepts can may reduce (or, alternatively, prevent) the image tearing phenomenon occurring when the transmission rate of image data from the host 1300 becomes instable and irregular. Further, the display driving circuit 1200 can be operated to enable stable display, regardless of transmission delay time of the interface included in the host 1300.

The timing controller 180 can create an EOS command indicating the completion of scanning of a specific image frame, a first periodic signal (TE), and a second periodic signal (Vsync).

The first periodic signal (TE) can be activated for each desired (or, alternatively, predetermined) cycle. However, the example embodiments of the inventive concepts are not limited thereto, and the first periodic signal (TE) can be created by the timing controller 180 such that it can be activated each time the EOF command for each image frame is received. Further, the first periodic signal (TE) can be created such that it is activated even when the EOF command for a specific image frame is received and the EOS command for the specific image frame created. The first periodic signal (TE) may include a rising edge and a falling edge for each cycle.

The first periodic signal (TE) can be transmitted to the external host 1300. Specifically, the first periodic signal (TE) can be transmitted to the external host 1300 through a bridge 1250 disposed between the host 1300 and the display driving circuit 1200. This host can transmit data including an image frame and an EOF command to the display driving circuit 1200 on the basis of the first periodic signal (TE).

The second periodic signal (Vsync) can be activated for each period. For example, the second periodic signal (Vsync) may be created as a periodic signal having a frequency of 60 Hz. The second periodic signal (Vsync) may be created in the form of impulse, or may be created such that it has a rising edge and a falling edge for each period. However, the example embodiments of the inventive concepts are not limited thereto.

In addition, the scan buffer switching controller 150 can receive the second periodic signal (Vsync) from the timing controller 180 instead of the EOS command. In this case, the scan buffer switching controller 150 can determine whether or not the EOF command for each image frame is received each time the second periodic signal (Vsync) is activated, and, when the EOF command is received, can switch the target buffer accessed by the buffer scan controller 130. That is, the scan buffer switching controller 150 can change the target buffer of the buffer scan controller 130 on the basis of the EOF command and the EOS command, or can change the target buffer of the buffer scan controller 130 on the basis of the EOF command and the second signal (Vsync). However, the example embodiments of the inventive concepts are not limited thereto.

The interface unit 160 can receives data from the host 1300. The interface unit 160 receives an image frame and an EOF command to transmit the image frame to the buffer write controller 110 and to transmit the EOF command to the write signal detector 140.

The interface unit 160 can receive data according to a first protocol system corresponding to the transmission system of the host 1300. Examples of the first protocol used in the interface unit 160 may include USB (Universal Serial Bus) protocol, MMC (multimedia card) protocol, PCI (peripheral component interconnection) protocol, PCI-E (PCI-express) protocol, ATA (Advanced Technology Attachment) protocol, Serial-ATA protocol, Parallel-ATA protocol, SCSI (small computer small interface) protocol, ESDI (enhanced small disk interface) protocol, and IDE (Integrated Drive Electronics) protocol; and PSI (Service provider interface), MDDI (Mobile display digital interface), and MIPI (Mobile industry processor interface). However, the example embodiments of the inventive concepts are not limited thereto.

Figure 4:
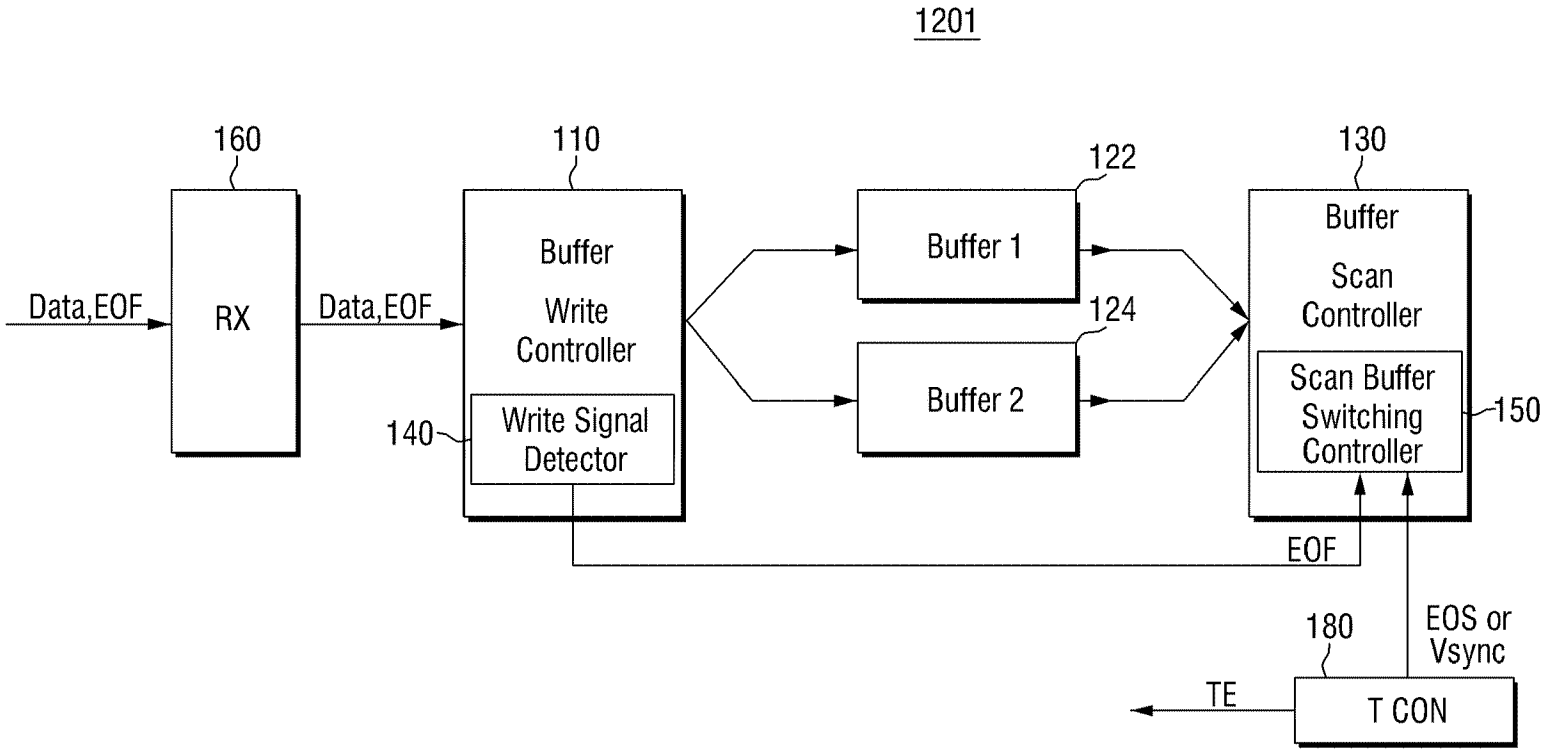
FIG. 4 is a block diagram illustrating a display driving circuit according to another example embodiments of the inventive concepts.

FIG. 4 is a block diagram illustrating a display driving circuit 1201 according to other example embodiments of the inventive concepts. For convenience, a redundant description of elements already described in the previous example embodiment will be omitted, and the current example embodiment will hereinafter be described, focusing mainly on differences with the previous example embodiment.

Referring to FIG. 4, a display driving circuit 1201 according to another example embodiment of the inventive concepts can be operated substantially in the same manner as the display drive circuit 1200 according to the previous example embodiments of the inventive concepts described with reference to FIG. 3.

The display driving circuit 1201 according to another example embodiment of the inventive concepts may include a buffer write controller 110, a buffer scan controller 130, a write signal detector 140, a scan buffer switching controller 150, a first buffer 122, a second buffer 124, a timing controller 180, and an interface unit (RX) 160. However, the write signal detector 140 may be included in the buffer write controller 110.

Therefore, the interface unit 160 can transmit the received image frame and End of Frame (EOF) command to the buffer write controller 110. In this case, the write signal detector 140 included in the buffer write controller 110 can detect the EOF command from the received data. When the EOF command is detected, the write signal detector 140 can control the buffer write controller 110 such that the buffer write controller 110 switches the target buffer for transmitting data.

Similarly, the scan buffer switching controller 150 may be included in the buffer scan controller 130. Therefore, the buffer scan controller 130 can receive the EOF command from the buffer write controller 110. Further, the buffer scan controller 130 can receive the EOS command or the second periodic signal (Vsync) from the timing controller 180.

Figure 5:
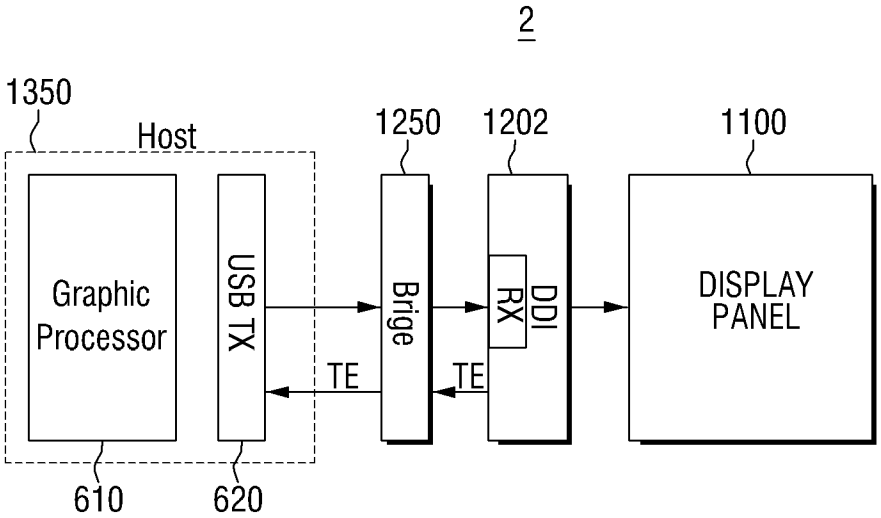
FIG. 5 is a block diagram illustrating a display device according to another example embodiments of the inventive concepts.
Figure 6:
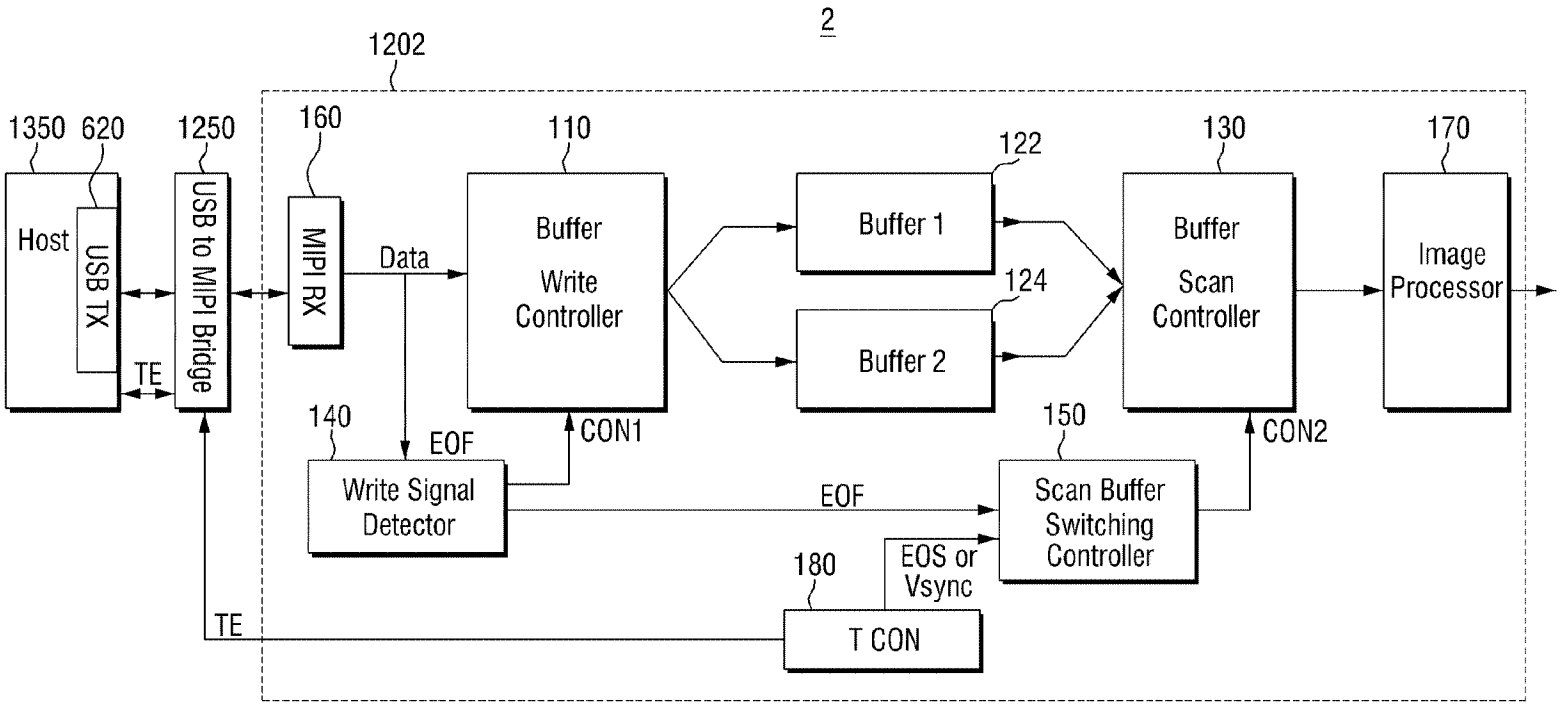
FIG. 6 is a block diagram specifically illustrating the display device of FIG. 5.

FIG. 5 is a block diagram illustrating a display device according to other example embodiments of the inventive concepts. FIG. 6 is a block diagram specifically illustrating the display device of FIG. 5.

Referring to FIGS. 5 and 6, the display device 2 according to other example embodiments of the inventive concepts may include a display panel 1100, a display driving circuit 1202, a bridge 1250, and a host 1350. The display device 2 according to other example embodiments of the inventive concepts can be operated substantially in the same manner as the display device 1 according to an example embodiments of the inventive concepts described with reference to FIG. 1.

However, the first protocol used at the time of data transmission from the host 1350 included in the display device 2 may be different from the second protocol used at the time of the display driving circuit 1202 receiving data.

The host 1350 may include a graphic processor 610 for processing image data to be outputted to the display panel 1100, and a transmitting unit 620 for transmitting the image data. The transmitting unit 620 can transmit the image data using the first protocol. In contrast, the interface unit 160 included in the display driving unit 1202 can receive the image data using the second protocol. In this case, the first protocol and the second protocol may be different from each other.

For example, the first protocol may include a USB protocol, and the second protocol may include an MIPI protocol.

The bridge 1250 can be used when the first protocol used in the host 1350 is different from the second protocol used in the display driving circuit 1202. The bridge 1250 can convert the data received through the first protocol to be suitable for the second protocol. Specifically, the bridge 1250 may be disposed between the host 1350 and the display driving circuit 1202. The bridge receives an image frame from the host 1350 through the first protocol, and converts the received image frame to be suitable for the second protocol used in the display driving circuit 1202, thereby transmitting the converted image frame to the display driving circuit 1202.

Further, the bridge 1250 can receives the first periodic signal (TE) outputted from the timing controller 180 included in the display driving circuit 1202, and can transmit the received first periodic signal (TE) to the host 1350.

The host 1350 can transmit the data including an image frame and an End of Frame (EOF) command on the basis of the first periodic signal (TE). For example, when the host 1350 is in a standby state, the host 1350 can transmit the image frame for each rising edge of the first periodic signal (TE), and, when the transmission of this image frame is completed, the host can transmit the EOF command. If the host 1350 is transmitting data to the rising edge of the first periodic signal (TE), the transmission of the image frame can start at the next rising edge of the first periodic signal (TE). However, the example embodiments of the inventive concepts are not limited thereto.

The interface unit 160 can receive the data including a plurality of image frames and a plurality of EOF (End Of Frame) commands from the host 1350. The write signal detector 140 can detect the EOF command from the received data, and can transmit the detected EOF command to the scan buffer switching controller 150. The write signal detector 140 can switch the target buffer accessed by the buffer write controller 110, each time the EOF command is detected. For example, when the EOF command is detected after the buffer write controller 110 records the first image frame in the first buffer 122, the write signal detector 140 transmit the first command (CON1) to the buffer write controller 110 to allow the buffer write controller 110 to record the second image frame in the second buffer 124.

The timing controller 180 can create an EOS (End Of Scan) command, a first periodic signal (TE), and a second periodic signal (Vsync). The timing controller 180 may transmit one or more of the EOS command and the second periodic signal (Vsync) to the scan buffer switching controller 150.

The first periodic signal (TE) can be activated for each desired (or, alternatively, predetermined) period. Further, the first periodic signal (TE) can be activated each time the EOF command for each image frame is received. Moreover, the first periodic signal (TE) can be created such that it is activated even when the EOF command for a specific image frame is received and the EOS command for the specific image frame created.

The scan buffer switching controller 150 can switch the target buffer scanned by the buffer scan controller 130 on the basis of the received EOF command and EOS command. Further, the scan buffer switching controller 150 can switch the target buffer scanned by the buffer scan controller 130 on the basis of the received EOF command and second periodic signal (Vsync). For example, the buffer scan controller 130 scans the first image frame previously stored in the second buffer 124. Subsequently, when the buffer scan controller 130 completes the scanning of the first image frame, the timing controller 180 creates an EOS command, and transmits this created EOS command to the scan buffer switching controller 150. At this time, the buffer write controller 110 records the second image frame in the first buffer 122, and, when the recording of the second image frame is completed, the write signal detector 140 receives the EOF command for the second image frame, and transmit the received EOF command to the scan buffer switching controller 150.

Subsequently, the scan buffer switching controller 150 transmits the second command (CON2) for switching the target buffer scanned by the buffer scan controller 130 from the second buffer 124 to the first buffer 122 to the buffer scan controller 130 because this scan buffer switching controller 150 receives both the EOS command for the first image frame and the EOF command for the second image frame. Subsequently, the buffer scan controller 130 scans the second image frame stored in the first buffer 122. The scanned second image frame is transmitted to the display panel 1100 through the image processor 170. However, the example embodiments of the inventive concepts are not limited thereto.

The image processor 170 can perform a post-processing for displaying the scanned image frame on the display panel 1100.

The display device 2 according to other example embodiments of the inventive concepts can prevent the image tearing phenomenon occurring when the transmission rate of image data from the host 1300 becomes unstable. Therefore, the display device 2 can be operated to enable stable display, regardless of transmission delay time of the interface included in the host 1350.

Figure 7:
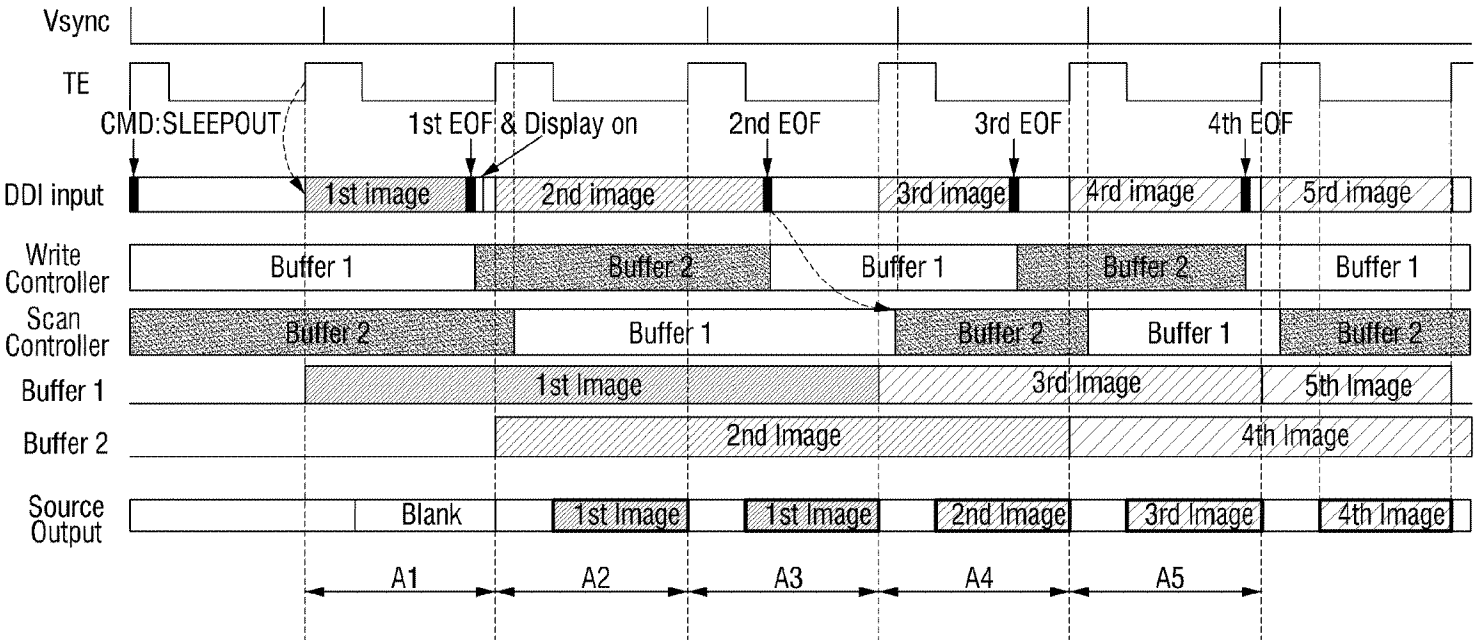
FIG. 7 is a timing chart illustrating the operation of the display driving circuit according to an example embodiments of the inventive concepts.

FIG. 7 is a timing chart illustrating the operation of the display driving circuit according to an example embodiment of the inventive concepts.

Referring to FIG. 7, before the first cycle of the first periodic signal (TE), the host 1300 transmits a sleep out command to the display driving circuit 1200 through the bridge 1250 to perform an initiation for image frame transmission.

In the first cycle (A1) of the first periodic signal (TE), the host 1300 can transmit the first image frame at the rising edge of the first periodic signal (TE) to the display driving circuit 1200. The buffer write controller 110 can transmit the first image frame to the first buffer 122. Subsequently, when the transmission of the first image frame is completed, the host 1300 can transmit the first End of Frame (EOF) command indicating the completion of transmission of the first image frame. However, the example embodiments of the inventive concepts are not limited thereto, and the first EOF command can be created in the display driving circuit 1200. Subsequently, when the first EOF command is received or created, the write signal detector 140 switches the first buffer 122 accessed by the buffer write controller 110 to the second buffer 124. In this case, the write signal detector 140 can replace the address of the target buffer accessed by the buffer write controller 110 with the address of the second buffer 124. Further, the host 1300 can transmit the display turn-on command (CMD) for commanding the output of the image frame stored in the buffer to the display panel 1100. However, the example embodiments of the inventive concepts are not limited thereto.

In the second cycle (A2) of the first periodic signal (TE), the host 1300 can transmit the second image frame at the rising edge of the first periodic signal (TE) to the display driving circuit 1200. The buffer write controller 110 can transmit the second image frame to the second buffer 124. In this case, since display has been turned on, the buffer scan controller 130 scans the first image frame stored in the first buffer 122. The buffer scan controller 130 can perform the scanning operation after a desired (or, alternatively, a predetermined time) from the falling edge of the first periodic signal (TE) or the second periodic signal (Vsync). When the scanning of the first image frame is completed, the timing controller 180 creates the first EOS (End Of Scan) command for the first image frame, and transmits this created EOS command to the scan buffer switching controller 150.

In the third cycle (A3) of the first periodic signal (TE), the buffer write controller 110 is still transmitting the second image frame to the second buffer 124. When the transmission of the second image frame is delayed because the transmission delay of the host 1300 or the like, the target buffer to be accessed is maintained until the transmission of the second image frame is completed. In other words, the buffer write controller 110 maintains the target buffer to be access until the second EOF command is transmitted to the write signal detector 140. Subsequently, when the transmission of the second image frame to the second buffer 124 is completed and the second EOF command is received, the write signal detector 140 changes the target buffer accessed by the buffer write controller 110 to the first buffer 122 using the first command (CON 1).

The scan buffer switching controller 150 maintains the target buffer accessed by the buffer scan controller 130 because the second EOF command has not been received at the falling edge of the first periodic signal (TE). Therefore, the buffer scan controller 130 scans the first image frame stored in the first buffer in the same manner as in the second cycle (A2). When the scanning of the first image frame is completed, the timing controller 180 creates the first EOS command for the first image frame again, and transmits this created first EOS command to the scan buffer switching controller 150.

In the fourth cycle (A4) of the first periodic signal (TE), the host 1300 can transmit the third image frame at the rising edge of the first periodic signal (TE) to the display driving circuit 1200. The buffer write controller 110 can transmit the third image frame to the first buffer 122. Subsequently, when the transmission of the third image frame is completed, the host 1300 can transmit the third EOF command indicating the completion of transmission of the third image frame. When the third EOF command is detected, the write signal detector 140 changes the buffer accessed by the buffer write controller 110 to the second buffer 124.

The scan buffer switching controller 150 switches the buffer accessed by the buffer scan controller 130 to the second buffer 124 because both the second EOF command and the first EOS command are received when the second periodic signal (Vsync) is activated. Subsequently, at the falling edge of the first periodic signal (TE), the buffer scan controller 130 scans the second image frame stored in the second buffer 124, and transmits this scanned second image frame to the display panel 110. When the scanning of the second image frame is completed, the timing controller 180 creates the second EOS command for the second image frame, and transmits this created second EOS command to the scan buffer switching controller 150.

In the fifth cycle (A5) of the first periodic signal (TE), the same operations as in the fourth cycle (A4) are repeated. The host 1300 can transmit the fourth image frame at the rising edge of the first periodic signal (TE) to the display driving circuit 1200. The buffer write controller 110 can transmit the fourth image frame to the second buffer 124. Subsequently, when the transmission of the fourth image frame is completed, the host 1300 can transmit the fourth EOF command indicating the completion of transmission of the fourth image frame. When the fourth EOF command is detected, the write signal detector 140 changes the buffer accessed by the buffer write controller 110 to the first buffer 122.

The scan buffer switching controller 150 switches the buffer accessed by the buffer scan controller 130 to the first buffer 122 because both the third EOF command and the second EOS command are received when the second periodic signal (Vsync) is activated. Subsequently, at the falling edge of the first periodic signal (TE), the buffer scan controller 130 scans the third image frame stored in the first buffer 122, and transmits this scanned third image frame to the display panel 110. When the scanning of the third image frame is completed, the timing controller 180 creates the third EOS command for the third image frame, and transmits this created third EOS command to the scan buffer switching controller 150. Thereafter, even in other cycles of the first periodic signal (TE), the above-mentioned series of operations can be repeated.

Figure 8:
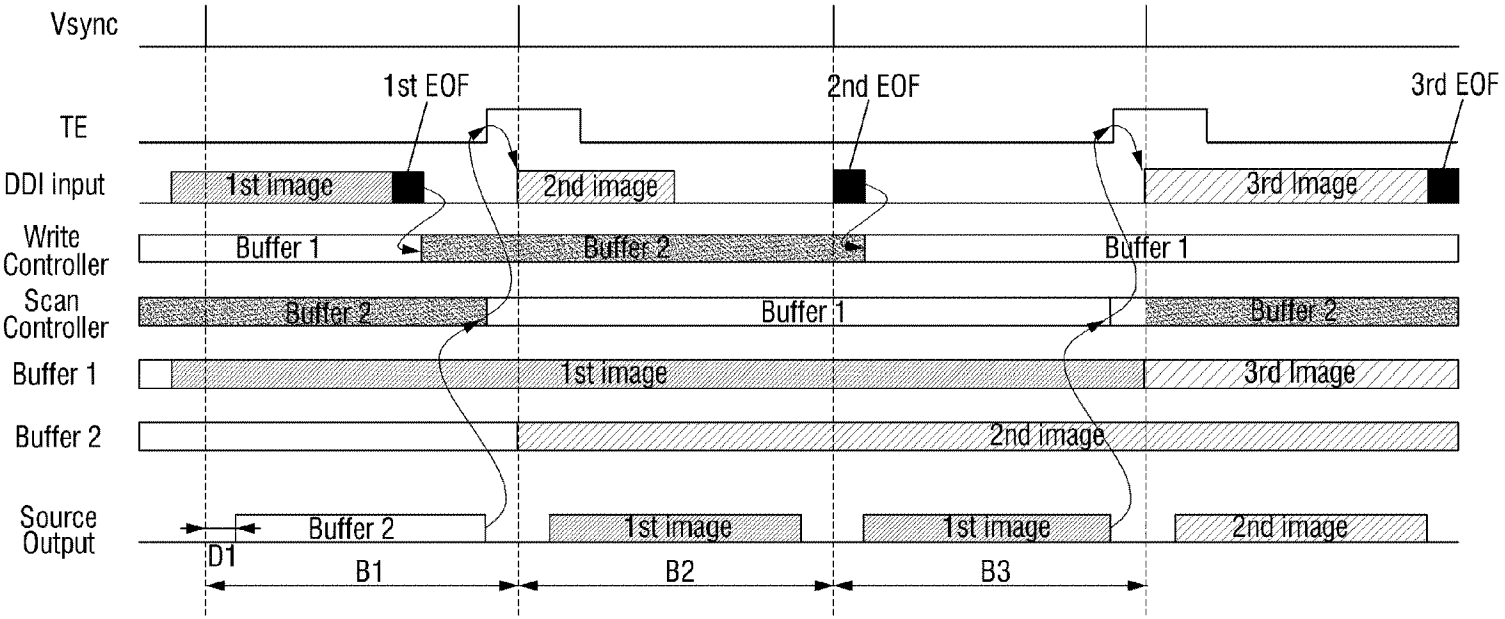
FIG. 8 is a timing chart illustrating the operation of the display driving circuit according to another example embodiments of the inventive concepts.

FIG. 8 is a timing chart illustrating the operation of the display driving circuit according to other example embodiments of the inventive concepts.

Referring to FIG. 8, the timing controller 180 of the display driving circuit 1200 according to other example embodiments of the inventive concepts can activate a first periodic signal (TE) only when the scanning of an image frame is completed and then an End of Frame (EOF) command for the image frame is received. The first periodic signal (TE) can be transmitted to the host 1300 through the bridge 1250. The host 1300 can transmit the image frame to the display driving circuit 1200 on the basis of the first periodic signal (TE) each time the first periodic signal (TE) is activated.

Specifically, although not clearly in the drawings, in the first cycle (B1) of the second periodic signal (Vsync), the host 1300 can transmit the first image frame at the rising edge of the first periodic signal (TE) to the display driving circuit 1200. The buffer write controller 110 can transmit the first image frame to the first buffer 122. Subsequently, when the transmission of the first image frame is completed, the host 1300 can transmit the first EOF command indicating the completion of transmission of the first image frame. However, the example embodiments of the inventive concepts are not limited thereto, and the first EOF command can be created in the display driving circuit 1200. Subsequently, when the first EOF command is received or created, the write signal detector 140 switches the first buffer 122 accessed by the buffer write controller 110 to the second buffer 124. Further, the write signal detector 140 transmits the received first EOF command to the scan buffer switching controller 150 and the timing controller 180.

The buffer scan controller 130 can scan the image frame synchronized with the second periodic signal (Vsync) to be stored in the second buffer 124. In this case, the scanning operation of the image frame can be performed after the first delay time (D1) from the second periodic signal (Vsync). When the scanning of the image frame is completed, the timing controller 180 creates an EOS (End of Scan) command, and transmits the created EOS command to the scan buffer switching controller 150.

When the scan buffer switching controller 150 receives both the first EOS command of the first image frame and the EOS command of the image frame stored in the second buffer 124, it can switch the target buffer scanned by the buffer scan controller 130 using the second command (CON2). In this way, the target buffer accessed by the buffer scan controller 130 is switched from the second buffer 124 to the first buffer 122.

Further, the timing controller 180 can receive the first EOF command of the first image frame, and can create an EOS command when the scanning of the image frame stored in the second buffer 124 is completed. When the timing controller 180 receives the first EOF command and creates the EOS command, the timing controller can activate the first periodic signal (TE).

In the second cycle (B2) of the second periodic signal (Vsync), the host 1300 can transmit the second image frame at the rising edge of the first periodic signal (TE) to the display driving circuit 1200. That is, the host 1300 can transmit the image frame each time the first periodic signal (TE) is activated. Further, the host 1300 can receive the first periodic signal (TE) from the timing controller 180.

The buffer scan controller 130 can scan the first image frame stored in the second buffer 124 (target buffer). The timing controller 180 can create the first EOS command when the scanning of the first image frame is completed. However, since the EOF command for the second image frame was not received in the second cycle (B2), the target buffers of the buffer write controller 110 and the buffer scan controller 130 are not switched.

In the third cycle (B3) of the second periodic signal (Vsync), the buffer write controller 110 receives the second EOF command for the second image frame from the host 1300. The write signal detector 140 detects the second EOF command, and switches the target buffer accessed by the buffer write controller 110 from the second buffer 124 to the first buffer 122.

However, since the target buffer of the buffer scan controller 130 was not changed yet, the buffer scan controller 130 scans the first image frame stored in the first buffer once again. Subsequently, when the scanning of the first image frame is completed and the first EOS command is created again, the write signal detector 140 switches the target buffer accessed by the buffer scan controller 130 from the first buffer 122 to the second buffer 124 because the first EOS command is received after the first EOF command is received. Subsequently, the timing controller 180 activates the first periodic signal (TE) again when it receives the second EOF command from the write signal detector and then creates the first EOS command. Thereafter, even in other cycles of the second periodic signal (Vsync), the above-mentioned series of operations can be repeated.

Figure 9:
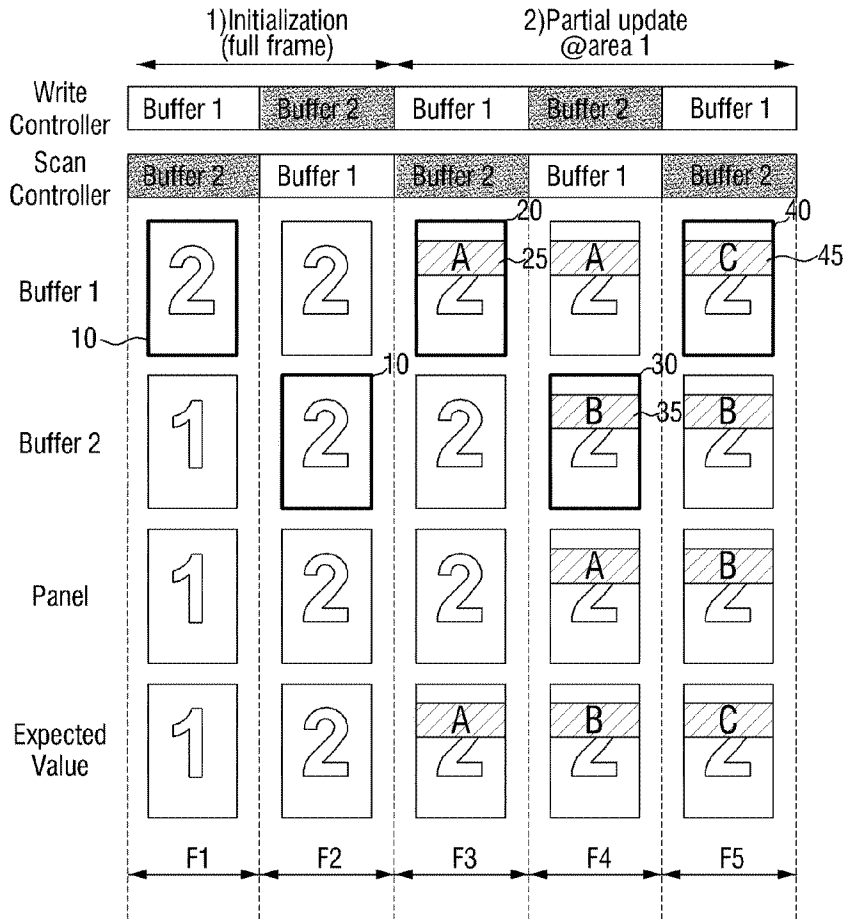
FIG. 9 is a timing chart illustrating the operation of the display driving circuit according to still another example embodiments of the inventive concepts.

FIG. 9 is a timing chart illustrating the operation of the display driving circuit according to still other example embodiments of the inventive concepts.

Referring to FIG. 9, the buffer write controller 110 of the display driving circuit 1200 can repeatedly transmit identical image frames when the received image frame includes only the updated information about a partial area of the immediately previous image frame.

Specifically, the buffer write controller 110 can receive a first image frame 10 and a second image frame 20 subsequent to the first image frame 10. In this case, when the second image frame 20 includes only the updated information about a partial area of the first image frame 10, the buffer write controller 110 transmits the first image frame 10 to the first buffer 122, and then transmits the first image frame 10 to the second buffer 124 again. Subsequently, the buffer write controller 110 can transmit only the partial updated area 25 of the first image frame 10 to the first buffer 122.

For example, the buffer write controller 110 performs a full image frame updating in the first cycle (F1) and the second cycle (F2). Subsequently, the buffer write controller 110 can perform the updating of only some areas (25, 35, 45) of the image frame in the third to fifth cycles (F3 to F5).

In the first cycle (F1), the buffer write controller 110 can transmit the first image frame 10 to the first buffer 122. The first image frame 10 may not be related with the image frame 10 previously stored in the second buffer 124. That is, the first buffer 122 and the second buffer 124 can store image frames different from each other in the first cycle (F1).

Subsequently, in the second cycle (F2), the buffer write controller 110 can transmit the first image frame to the second buffer 124. That is, the buffer write controller 110 can repeatedly transmit the first image frame to both the first buffer 122 and the second buffer 124. Therefore, the first buffer 122 and the second buffer 124 can store identical image frames in the second cycle (F2).

Then, in the third cycle (F3), the buffer write controller 110 can transmit only the updated information about a partial area (25) of the first image frame to the first buffer 122. However, the example embodiments of the inventive concepts are not limited thereto, and the buffer write controller 110 can transmit the entire second image frame 20 including the first image frame 10 and the updated information about the partial area (25) thereof.

Subsequently, in the fourth cycle (F4), the buffer write controller 110 can transmit only the updated information about a partial area (35) of the first image frame to the second buffer 124. However, even in this case, the buffer write controller 110 can transmit the entire third image frame 30 including the first image frame 10 and the updated information about the partial area (35) thereof.

Subsequently, in the fifth cycle (F5), the buffer write controller 110 can update a different image only in the same area updated in the third cycle (F3).

Thorough the above series of processes, the display driving circuit 1200 can accurately output the image values expected by user to the display panel 1100 during the updating process of the partial area.

Figure 10:
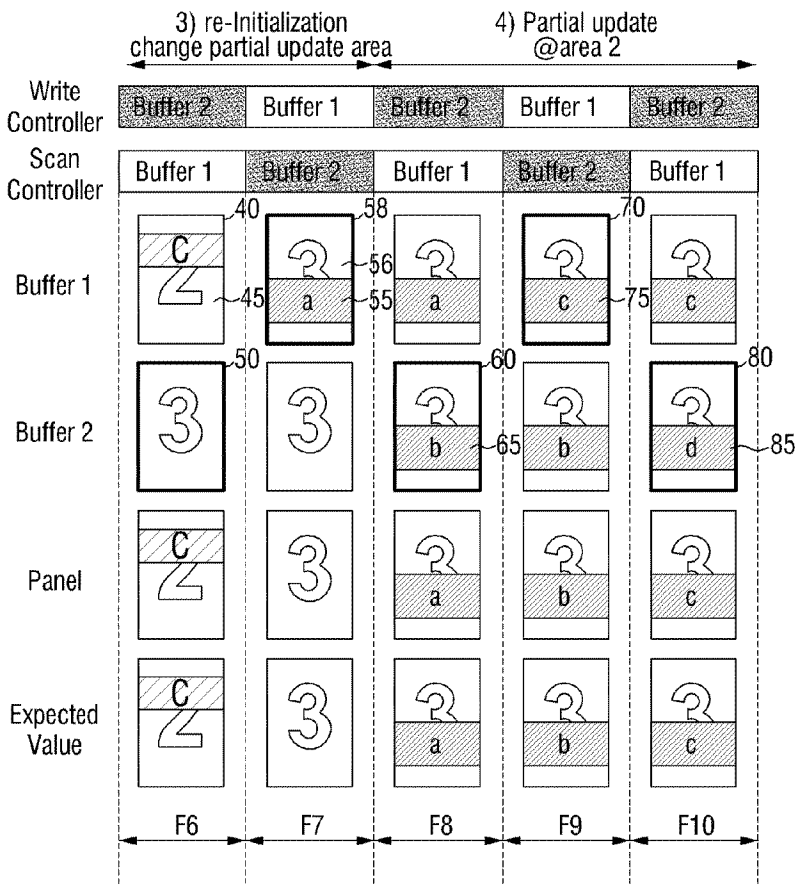
FIG. 10 is a timing chart illustrating the operation of the display driving circuit according to still another example embodiments of the inventive concepts.

FIG. 10 is a timing chart illustrating the operation of the display driving circuit according to still other example embodiments of the inventive concepts.

Referring to FIG. 10, when the received image frame includes only the updated information about a partial area of the immediately previous image frame, the buffer write controller 110 of the display driving circuit 1200 can include a new image frame after the previous image frame and the updated information thereabout, and can transfer this new image frame to a buffer.

Specifically, the buffer write controller 110 can receive a first image frame 50 and a second image frame (not shown) subsequent to the first image frame 50. In this case, when the second image frame (not shown) includes only the updated information about a partial area 55 of the first image frame 50, the buffer write controller 110 transmits the first image frame 50 to the first buffer 122, and then transmits a separate third image frame 58 including the first image frame 50 and the updated formation about the partial area 55 thereof.

For example, explaining in the cycles subsequent to the fifth cycle (F5) described in FIG. 9, the buffer write controller 110 performs a full image frame updating in the sixth cycle (F6) and the seventh cycle (F7). Subsequently, the buffer write controller 110 can perform the updating of only some areas (65, 75, 85) of the image frame again in the eighth to tenth cycles (F8 to F10).

In the sixth cycle (F6), the buffer write controller 110 can transmit the first image frame 50 to the second buffer 124. The first image frame 50 may not be related with the image frame 40 previously stored in the first buffer 122. That is, the first buffer 122 and the second buffer 124 can store image frames different from each other in the sixth cycle (F6).

After, in the seventh cycle (F7), the buffer write controller 110 can receive a second image frame (not shown) including only the updated information about a partial area 55 of the first image frame 50. Subsequently, the buffer write controller 110 can transmit a third image frame 58 including the first image frame 50 and the updated information to the first buffer 122. In this case, the non-updated area of the second image frame (not shown) may be the same as another partial area 56 of the first image frame 50 stored in the first buffer 122. Therefore, in the seventh cycle (F7), other partial areas 56 stored in the first buffer 122 and the second buffer 124 may be the same as each other.

Subsequently, in the eighth cycle (F8), the buffer write controller 110 can transmit only the updated information about a partial area (65) of the first image frame 50 to the second buffer 124. However, the example embodiments of the inventive concepts are not limited thereto, and the buffer write controller 110 can transmit the entire fourth image frame 60 including the first image frame 50 and the updated information about the partial area (65) thereof.

Subsequently, in the ninth cycle (F9), the buffer write controller 110 can transmit only the updated information about a partial area (75) of the third image frame 58 to the first buffer 122. However, even in this case, the buffer write controller 110 can transmit the entire fifth image frame 70 including the third image frame 58 and the updated information about the partial area (75) thereof.

Subsequently, in the tenth cycle (F10), the buffer write controller 110 can update a different image only in the same area 65 updated in the third cycle (F3).

Thorough the above series of processes, the display driving circuit 1200 can accurately output the image values expected by user to the display panel 1100 during the updating process of the partial area.

Figure 11:
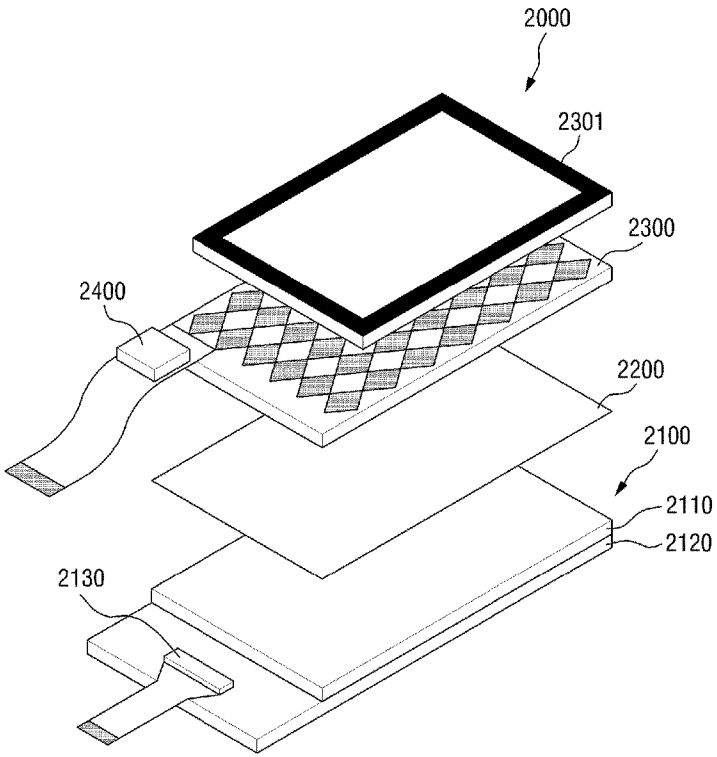
FIG. 11 is a perspective view showing a display module according to some example embodiments of the inventive concepts.

FIG. 11 is a perspective view showing a display module according to some example embodiments of the inventive concepts.

Referring to FIG. 11, the display module 2000 includes a display device 2100, a polarizing plate 2200, and a window glass 2301. The display device 2100 may include a display panel 2110, a printed board 2120, and a display driving chip 2130.

The window glass 2301 is generally made of a material such as acrylate or reinforced glass, and protects the display module 2000 from scratches caused by external shocks or repeated touches. The polarizing plate 2200 may be provided in order to improve the optical properties of the display panel 2110. The display panel 2110 is formed by patterning a transparent electrode on the printed board 2120. The display panel 2110 includes a plurality of pixels for display image frames. According to example embodiments of the inventive concepts, the display panel 2110 may be an organic light-emitting diode panel. Each of the pixels includes an organic light-emitting diode which emits light in response to the flow of electric current. However, the example embodiments of the inventive concepts are not limited thereto, and the display panel 2110 may include various kinds of display elements. For example, the display panel 2110 may be any one of LCD (Liquid Crystal Display), ECD (Electrochromic Display), DMD (Digital Mirror Device), AMD (Actuated Mirror Device), GLV (Grating Light Value), PDP (Plasma Display Panel), ELD (Electroluminescent Display), LED (Light Emitting Diode) display, and VFD (Vacuum Fluorescent Display).

The display driving chip 2130 may include the above-mentioned display driving circuit 1200, 1201 or 1202. In the present embodiment, one display driving chip is provided, but a plurality of display driving chips may be provided. Further, the display driving chip 2130 may be mounted on the glass-made printed board 2120 in the form of COG (Chip On Glass). However, the example embodiments of the inventive concepts are not limited thereto, and the display driving chip 2130 may be mounted in various forms such as COF (Chip on Film) and COB (chip on board).

The display module 2000 may further include a touch panel 2300 and a touch controller 2400. The touch panel 2300 is formed by patterning a transparent electrode such as an indium tin oxide (ITO) electrode on a glass substrate or a polyethylene terephthalate (PET) film. The touch controller 2400 detects the occurrence of touch on the touch panel to calculate touch coordinates, and transmits these touch coordinates to a host (not shown). The touch controller 2400 may be integrated into one semiconductor chip together with the display driving chip 2130.

Figure 12:
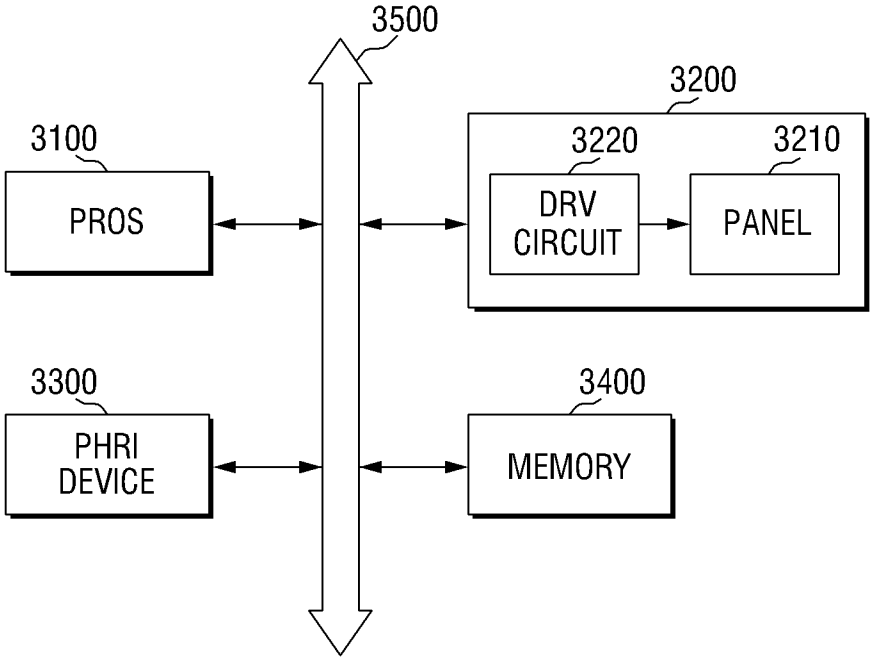
FIG. 12 is a block diagram showing a display system according to some example embodiments of the inventive concepts.

FIG. 12 is a block diagram showing a display system according to some example embodiments of the inventive concepts.

Referring to FIG. 12, the display system includes a system bus 3500, a processor 3100 electrically connected to the system bus 3500, a display device 3200, a peripheral device 3300, and memory 3400.

The processor 3100 controls the data input and output among the peripheral device 3300, the memory 3400, and the display device 3200, and performs the image processing of image data transmitted among these devices.

The display device 3200 includes a panel 3210 and a driving circuit 3220, and stores the image data applied through the system bus 3500 in the frame memory included in the driving circuit 3220 and then displays this image data on the panel 3210. The display device 3200 may be the display device 1 or 2 shown in FIG. 1 or FIG. 5. Therefore, the display device 3200 is operated asynchronously with the processor 3100, thereby reducing the systematic burden of the processor 3100.

The peripheral device 3300 may be a device for converting a moving image or a still image into electrical signals, such as a camera, a scanner or a webcam. The image data obtained through the peripheral device 3300 may be stored in the memory 3400 or may be displayed on the panel of the display device in real time.

The memory 3400 may include a volatile memory device, such as DRAM, and/or a non-volatile memory device, such as flash memory. The memory 3400 may be composed of DRAM, PRAM, MRAM, ReRAM, FRAM, NOR flash memory, NAND flash memory, and fusion flash memory (for example, memory in which a SRAM buffer, NAND flash memory and NOR interface logic are combined). The memory 3400 may store the image data obtained from the peripheral device 3300, or may store the image signal processed by the processor 3100.

The display system according to example embodiments of the inventive concepts may be provided in a mobile electronic product such as a smart phone. However, the example embodiments of the inventive concepts are not limited thereto. The display system 3000 may be provided in various kinds of electronic products.

Figure 13:
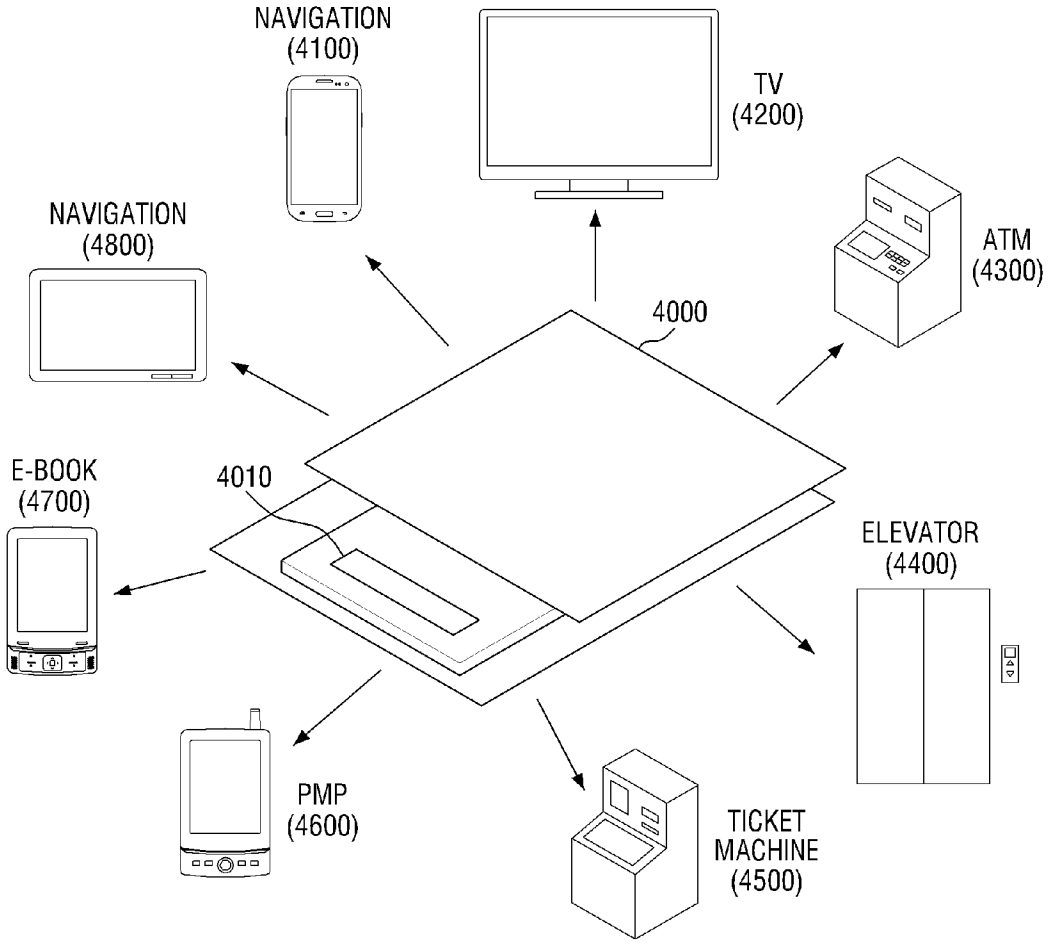
FIG. 13 is a schematic view showing an example of the application of various electronic products mounted with the display devices according to some example embodiments of the inventive concepts.

FIG. 13 is a schematic view showing application examples of various electronic products provided with the display devices according to some example embodiments of the inventive concepts.

The display device 4000 according to some example embodiments of the inventive concepts can be employed in various electronic products. Specifically, this display device 4000 can be widely used in TV 4200, ATM 4300 for automatically executing the deposit and withdrawal of cash of the bank, an elevator 4400, a ticket dispenser 4500 used in the subway or the like, PMP 4600, e-book 4700, a navigation 4800, and the like.

The display device 4000 according to some example embodiments of the inventive concepts can be operated asynchronously with the processor of the display system. Therefore, the burden of driving the processor can be reduced, and thus the processor can be operated at low power and high speed, thereby improving the function of an electronic product.

While the example embodiments of the inventive concepts have been particularly shown and described with reference to example embodiments thereof, it will be understood by those of ordinary skill in the art that various changes in form and details may be made therein without departing from the spirit and scope of the example embodiment of the inventive concepts as defined by the following claims. It is therefore desired that the present embodiments be considered in all respects as illustrative and not restrictive, reference being made to the appended claims rather than the foregoing description to indicate the scope of the inventive concepts.

What is claimed is:

1. A display driving circuit, comprising:

a buffer write controller configured to transmit a first image frame to a first buffer and a second image frame to a second buffer based on a first control command, the first image frame and the second image frame being sequential image frames received from a host;

a buffer scan controller configured to scan different ones of the first image frame stored in the first buffer and the second image frame stored in the second buffer based on a cycle and a second control command;

a timing controller configured to, generate an End Of Scan (EOS) command indicating that the buffer scan controller has completed scanning of the first image frame, and transmit a first periodic signal to the host only when an End of Frame (EOF) command is received and the EOS command is generated, the EOF command indicating that transmission of the first image frame to the first buffer is complete, and the first periodic signal being a signal instructing the host to transmit a next one of the sequential image frames;

a write signal detector configured to generate the first control command to control the buffer write controller such that the second image frame is transmitted to the second buffer only after the first image frame is transmitted to the first buffer; and a scan buffer switching controller configured to, receive the EOF command, and generate the second control command to control the buffer scan controller based on the EOF command and the EOS command such that the first image frame is scanned only after the EOF command indicates that transmission of the first image frame from the host to the first buffer is complete, and the EOS command indicates that a prior second image frame stored in the second buffer is scanned.

2. The display driving circuit according to claim 1, wherein the write signal detector is configured to, receive the EOF command, after the buffer write controller transmits the first image frame or the second image frame, and determine whether the buffer write controller transmits an image frame to the first buffer or the second buffer based on the EOF command.

3. The display driving circuit according to claim 1, wherein the write signal detector is configured to, generate the EOF command each time the buffer write controller transmits the first image frame or the second image frame, and transmit the EOF command to the scan buffer switching controller.

4. A display driving circuit configured to process image frames including a first image frame and a second image frame, comprising:

a first buffer and a second buffer configured to store ones of the image frames;

a buffer write controller configured to, receive the image frames successively, and alternately transmit the first image frame to the first buffer and the second image frame to the second buffer such that, when the second image frame includes updated information associated with only a partial area of the first image frame, the buffer write controller is configured to transmit an entirety of the first image frame to the first buffer in a first cycle, transmit the entirety of the first image frame to the second buffer again in a second cycle such that the first buffer and the second buffer store identical ones of the image frames in the second cycle, and then transmit only the updated information associated with the partial area to the first buffer in a third cycle, the first cycle the second cycle and the third cycle being subsequent cycles of a periodic signal generated each time an end of frame (EOF) command is received, the EOF command indicating that transmission of one of the image frames to a corresponding one of the first buffer and the second buffer is complete, and a buffer scan controller alternately scanning the image frames stored in the first buffer or the second buffer.

5. A display driving circuit configured to process image frames including a first image frame and a second image frame, the circuit comprising:

a driving controller configured to, alternately transmit the first image frame received from a host to a first buffer and the second image frame received from the host to a second buffer based on an End Of Frame (EOF) command, the first image frame being a different image from the second image frame and the EOF command indicating that the host has completed transmission of a respective one of the image frames, generate an End of Scan (EOS) command, if the driving controller completes scanning one of the first buffer and the second buffer, the EOS command indicating that the driving controller has completed scanning the one of the first buffer and the second buffer and transmitted a respective one of the first image frame and the second image frame to a display panel, transmit a first periodic signal to the host only when the EOF command is received and the EOS command is generated, and the first periodic signal instructing the host to transmit a next one of the image frames, and alternately scan the first buffer and the second buffer based on at least on the EOF command and the EOS command such that the second buffer is scanned only after the EOF command indicates that transmission of the second image frame from the host to the second buffer is complete and the EOS command indicates that the first buffer is scanned.

6. The display driving circuit of claim 5, wherein the driving controller is further configured to generate a second periodic signal.

7. The display driving circuit of claim 5, wherein the driving controller is configured to re-scan a first one of the first buffer and the second buffer until confirmation that a second one of the first buffer and the second buffer has been updated.

* * * * *